United States Patent [19]

Price

[11] Patent Number: 4,577,445

[45] Date of Patent: Mar. 25, 1986

[54] INSULATION PANEL ASSEMBLY FOR USE IN THE ROOFING AND/OR THE CLADDING OF WALLS OF BUILDINGS

[75] Inventor: William F. Price, Rhu, United Kingdom

[73] Assignee: Ecometal Limited, Glasgow, United Kingdom

[21] Appl. No.: 645,412

[22] Filed: Aug. 28, 1984

[51] Int. Cl.[4] ..... E04B 1/62; E04B 1/74

[52] U.S. Cl. ..... 52/403; 52/556; 52/601; 52/822

[58] Field of Search ..... 52/394, 403, 521, 536, 52/556, 601, 822

[56] References Cited

U.S. PATENT DOCUMENTS

| | | | |
|---|---|---|---|
| B 335,199 | 5/1943 | Behin | 52/403 |
| 2,021,922 | 11/1935 | Peck | 52/601 |
| 2,703,004 | 3/1955 | Kenedy | 52/601 |
| 3,062,337 | 11/1962 | Zittle | 52/394 X |
| 3,367,076 | 2/1968 | O'Brien | 52/394 |
| 3,466,831 | 9/1969 | Lenoir | 52/394 X |
| 3,998,679 | 12/1976 | Gwynne | 52/601 X |
| 4,107,892 | 8/1978 | Bellem | 52/403 |

*Primary Examiner*—Stuart S. Levy

*Assistant Examiner*—Lloyd Doigan

*Attorney, Agent, or Firm*—Mason, Fenwick & Lawrence

[57] ABSTRACT

The panel assembly comprises an elongate panel preformed from mineral fibres having a density of not less than 180 kg/m$^3$ and having two major faces and two longitudinal side edge faces, two elongate metal sections, each comprising a web engaging on one side thereof one of the side edge faces, a first flange at one longitudinal edge of the web and extending at right angles thereto from one side thereof, a second flange at the other longitudinal edge of the web and extending at an inclination thereto from the one side thereof and towards the first flange, and a channel in the web opening to the other side thereof for receiving a vapor seal. The first flange is fitted flush against one major face, the second flange is fitted into a correspondingly inclined first groove extending the full length of the panel and cut into the respective side edge face thereof intermediate the major faces, and the channel is fitted into a corresponding second groove cut into the respective side edge face of the panel intermediate the inclined first groove and the one major face exclusively by sliding the section along the respective side edge of the panel. A metal sheet is placed loosely on the other major face of the panel.

5 Claims, 2 Drawing Figures

INSULATION PANEL ASSEMBLY FOR USE IN THE ROOFING AND/OR THE CLADDING OF WALLS OF BUILDINGS

TECHNICAL FIELD

This invention relates to an insulation panel assembly for use in the roofing and/or the cladding of walls of buildings.

BACKGROUND

Pre-insulated roofing and wall panels have come into wide use for the weathering and insulation of many types of building and are commonly referred to as composite or bonded insulation panels or sheets. In the case of composite panels, such as disclosed in U.S. Pat. No. 3,464,831, foam plastics material is injected between two layers of metal or membrane. A bonded insulation panel is a profiled metal sheet with a layer of foam plastics insulation material bonded to the underside.

Several forms of jointing sections, including plastics and metal sections, have been utilised to join insulation panels side-by-side. These jointing sections have normally been provided for aesthetic reasons in that they have hidden the joints between panels. There is, however, a problem associated with such joints in providing an effective vapour seal which prevents warm moist air passing through the joint and condensing on the cold surface of the outer metal or plastics weathering sheet. When condensation occurs, the resulting liquid can drip through the joint into the building. Serious problems of condensation occur when voids in the construction are created as is the case in bonded panels.

Virtually all known pre-insulated sheets rely on foam plastics insulating materials which are dimensionally unstable and, when applied to metal sheets, the considerable differences in coefficients of expansion of the two materials lead to breakdowns in adhesion of the insulation to the metal sheets. A major disadvantage of foam plastics insulating materials is that they are thermally decomposable to liberate toxic and noxious fumes with emission of dense smoke.

The advent of pre-insulated composite or bonded panels had its origin in the difficulties of site-assembled insulated roofing and cladding. The site-assembled methods relied entirely on the expertise of the erector or installer and were subject to prevailing weather conditions. The problems of achieving effective insulation coupled with endeavours to avoid serious condensation promoted the development of factory insulated products.

U.S. Pat. No. 2,142,305 discloses gypsum panels having on each of two opposite edges complementary metallic elements. The gypsum panels are precast and may be reinforced by mineral fibres which are admixed with the liquid cementitious material prior to casting of the latter. The metallic elements are keyed to the opposite edges of the panels during the pouring of the cementitious material. The metallic elements extend the full length of the panel and are flanged at their longitudinal edges, with the flanges extending parallel to major faces of the panels and lipped at their free edges to key into the cementitious material when the latter is poured to cast the panels. The flanges are usually flush with the major faces of the panels but one or both of them may be embedded in the cementitious material so that it is not exposed on the outside of the slabs. The complementary shaping of the two metallic elements on opposite sides of a panel is intermediate the depths of the elements, i.e. at positions spaced from both flanges. In a modification of construction where one flange of each metallic element is flush with a major surface of the panel and the other is embedded, with the complementary shaping of the metallic elements intermediate the two flanges providing tongue and groove interengagement with adjacent slabs, a flange is not provided at the embedded edge of the metallic element shaped to provide a groove, and, instead the length of metal at the groove opening side remote from the flush flange is bent back and splayed relative to the flush flange.

The metallic elements are fast with the cast cementitious material in panels in accordance with U.S. Pat. No. 2,142,305. Thus there are cold bridges between the two materials with temperature transfers between the two materials.

DISCLOSURE OF THE INVENTION

The principal object of the present invention is to provide an insulated roof and wall cladding panel of a two-stage construction which eliminates the need for bonding the panel formed of high density mineral fibre material to metal sections on each of the two opposite side edges thereof.

In accordance with the present invention there is provided an insulation panel assembly for use in the roofing and/or cladding of walls of buildings, comprising a preformed elongate panel of mineral fibres having a density of not less than 180 $Kg/M^3$, the panel having major faces and longitudinal side edge faces, a longitudinal slot extending the full length of the panel and cut into each side edge face intermediate the depth thereof with an inclination in the direction of the said depth towards one of the major faces of the panel, and an elongate metal section fitted to each side edge face of the panel by endwise sliding of the section and extending the full length of the panel, the section comprising a web engaging the portion of the side edge face between the slot and the said one major face, a first flange at one longitudinal edge of the web flush against the said one major face and a second flange at the other longitudinal edge of the web fitting into the slot.

BRIEF DESCRIPTION OF THE DRAWINGS

Embodiments of the invention will now be described, by way of example, with reference to the accompanying drawings, in which:

FIG. (1) is a vertical cross-sectional view through roofing or wall according to the present invention, and FIG. (2) is a vertical cross-sectional view through a wall according to the present invention, the wall being turned through 180° for ease of illustration.

BEST MODE OF CARRYING OUT THE INVENTION

Figure 1:
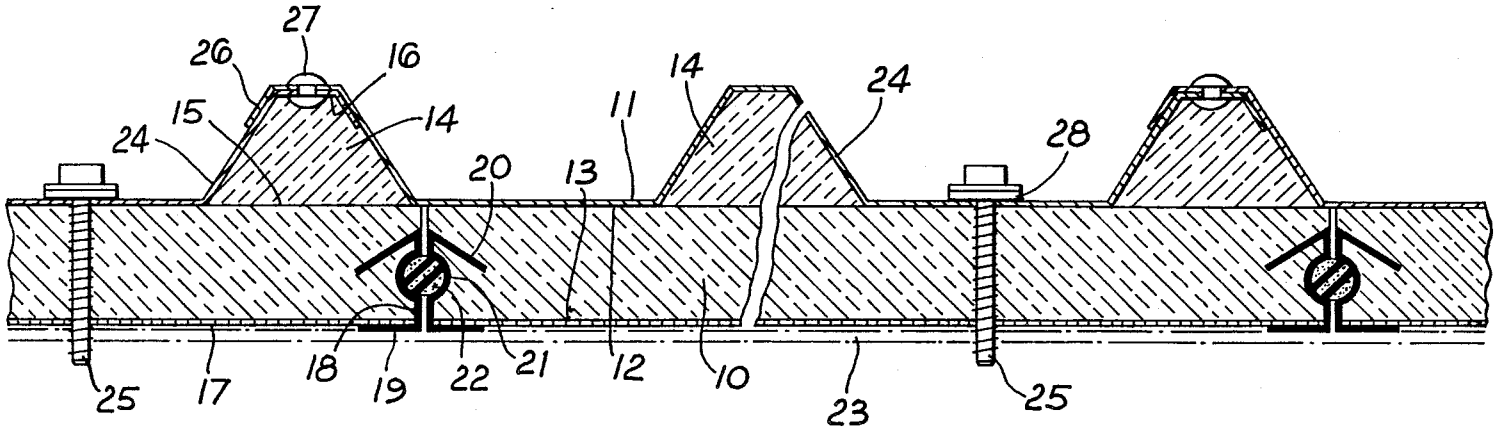
Figure 2:
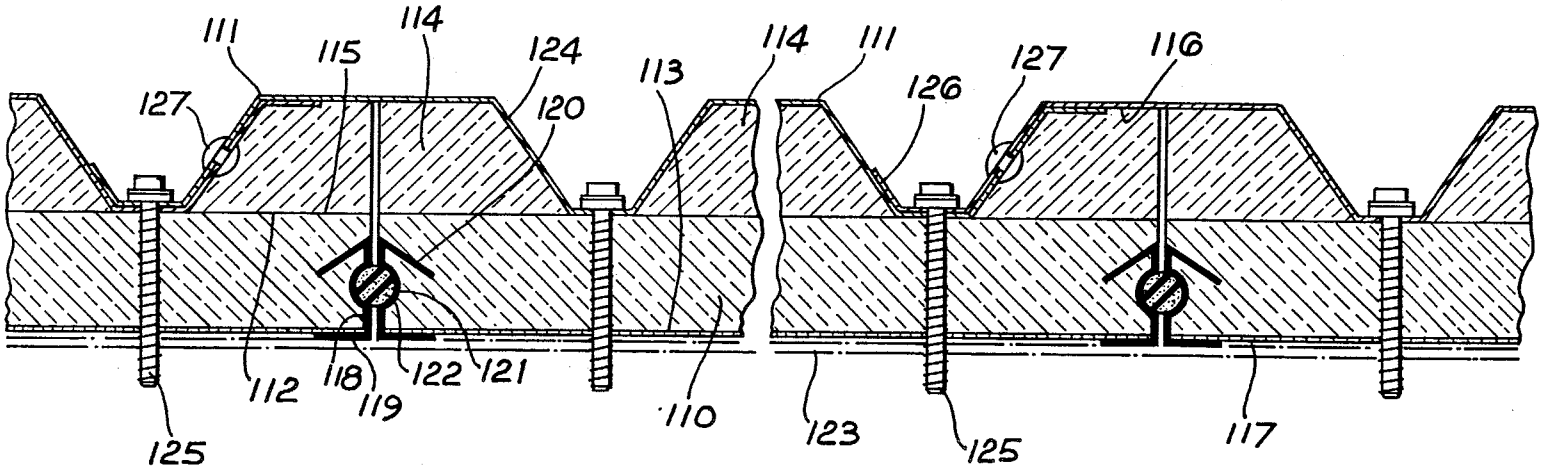

Referring to FIG. (1), roofing consists generally of a plurality of mineral fibre panels 10, and a plurality of profiled metal sheets 11 overlying the panels.

Each of the panels 10 is preformed and rectangular in plan view and in cross-section and has upper and lower parallel major faces, 12 and 13, respectively. On the upper face 12, there are located a plurality of laterally-spaced bars 14 of trapezoidal cross-section which are preformed separately from mineral fibre and have their bases 15 adhesively secured to the upper face 12 of each panel. The upper face 16 of each bar 14 is flat and parallel to the base 15, thereof, and the side wall are convergent upwards towards the upper flat face. The bars 14 are parallel to one another and extend over the full length of each panel. The panels 10 and bars 14 have a preferred density of 200 $Kg/M^3$ and not less than 180 $Kg/M^3$.

The lower face 13 of each panel 10 is covered by a lining sheet 17 of white painted aluminium foil or other metal, or wood, or plastics material, or glass-reinforced cement, the sheet 17 being bonded to the face 13 possibly by adhesive, but preferably by heat sealing.

Each panel 10 has fitted to each of its side edge faces a metal section 18 extending the full length of the panel 10 and flanged at both longitudinal edges. One flange 19, the lower flange is flush against the sheet 17 covering the inner or lower face 13 of the panel 10 and the other flange 20 penetrates the panel 10 at an inclination towards said inner or lower face 13 of the panel, a slot being cut for the latter purpose in the side edge face of the panel 10. The metal section 18 has substantially centrally intermediate its depth an inwardly-directed groove 21 which seats in a groove also cut into the side edge face of the panel 10. The flanged metal section 18 is slid endwise to the panel 10 and is held against displacement laterally outwards of the latter by virtue of the inclined flange 20. As can be seen in FIG. (1), the metal section 18 may extend over about three-quarters or less of the thickness of the panel 10 from the inner or lower face 13 of the panel 10. The groove 21 complements the groove 21 in the metal section 18 set into the opposed side edge face of the adjacent panel 10 and provides a duct for a vapour seal 22 made of extruded polyethylene.

As supplied to a building site, the vapour seals 22 are bonded into the grooves 21 in the metal sections 18 on single corresponding sides of the panels 10.

Each panel 10, at its ends, rests on top of adjacent purlins 23 of the roof supporting structure and once the panels 10 are assembled, the profiled metal sheets 11 are placed loosely on top of the panels 10. Each profiled metal sheet 11 has corrugations 24 corresponding to the bars 14 on each panel so that the bars 14 fit into the corrugations 24, and each profiled metal sheet extends from top to bottom of an end-to-end row of panels 10.

The panels 10 are clamped betwen the metal sheets 11 and the purlins 23 by self-tapping screws 25 which pass through the sheets 11 and the panels 10 into the purlins 23, the screws 25 being fitted with sealing washers 28. Each sheet 11 extends throughout the width of a panel 10 and has a laterally projecting extension 26 which overlaps the sheet 11 overlying the adjacent panel 10 and is of partial valley formation and engages over and around the upper face 16 of the adjacent bar 14 of the adjacent panel. The overlapping portions of the metal sheets 11 may be secured together by rivets 27, or self-tapping screws.

Each panel 10 may, for example, be 600 mm to 1000 mm in width and max 3000 mm long, and may have bars spaced at 75 mm to 300 mm: the thickness of each panel may be 30 mm to 120 mm and the thickness of each bar may be 20 mm to 120 mm.

With reference to the wall shown in FIG. (2), the arrangement is basically the same as the roofing shown in and described with reference to FIG. (1) and corresponding parts are denoted by the same reference numerals increased by one hundred.

In FIG. (2) the bars 114 of trapezoidal cross-section are much wider than the bars 14 of FIG. (1) and the valleys between the bars are much narrower, there being indeed an interchange of dimensions between the two such that the profiled metal sheets 111 of FIG. (2) correspond to the profiled metal sheets 11 of FIG. (1) when inverted. Also, at each side of each panel 110 there is only a vertically and longitudinally divided portion of a bar 114, each such portion complementing the portion at the adjacent side of the adjacent panel when the panels 110 are juxtaposed in the construction of a wall. In this case, of course, the panels 110 are clamped between the profiled metal sheets 111 and rails 123 by self-tapping screws 125 which pass through the sheets 111 and the panels 110 into the rails 123.

Different forms of double-flanged metal sections may be set into the side edge faces of the panels 10 and 110 instead of the metal sections 18 and 118 shown in FIGS. (1) and (2). In each case there are two double-flanged metal sections to be set into adjacent side edge faces of adjacent panels in a roofing or wall construction. The flanges in each case are the same as those of the FIGS. (1) and (2) metal sections, but the metal sections themselves are modified.

One metal section 18 or 118 may be formed with a centally-located longitudinal round-bottomed recess and the other metal section 18 or 118 with a centrally-located longitudinal projection of shape similar to the recess so as to enter the latter when the adjacent panels are juxtaposed.

Alternatively, one metal section 18 or 118 is formed with a centrally-located longitudinal V-shaped recess and the other metal section 18 or 118 with a centrally-located longitudinal projection of arrow-head section dimensioned to enter the recess when the adjacent panels are juxtaposed.

In another alternative, the arrangement is somewhat similar to that in FIGS. (1) and (2) but the inwardly-directed longitudinal grooves are V-shaped, the vapour seal accommodated in the resulting rectangular-section duct consequently being of rectangular section.

In a further alternative, the metal sections 18 or 118 are straight and fit flush together.

In yet another alternative, one metal section 18 or 118 is formed with a step adjacent to the flange 19 or 119 and the other metal section 18 or 118 is formed with a corresponding indent.

To provide for passage of day-light through a roof or wall, any panel 10 of the roofing of FIG. (1) may be replaced by a light-transmissive panel, the profiled metal sheet 11 and panel 10 being replaced by profiled translucent or transparent sheets of reinforced glass fibre or plastics material spaced apart by mineral fibre spacer units occurring at each purlin or rail and incorporating condensation drainage grooves.

INDUSTRIAL APPLICABILITY

As a result of the invention, roofing can be assembled or a wall can be built, easily, quickly and safely by skilled or semi-skilled labour. The problems associated with complex multi component in situ assembled systems or known roof panels comprising profiled metal sheets insulated with foamed polystyrene or polyurethane are avoided, especially the danger of fire, dense smoke and toxic fumes in the event of fire. Moreover, the preformed mineral fibre panels provide increased thermal and acoustic insulation, and they are proof against fire, moisture, rot and vermin. Although the preformed mineral fibre panels are, in themselves, friable the double-flanged metal sections render the panels rigid and capable of spanning two or more supports. The density of the panels is sufficient to permit slots to be cut into the side edge faces of the panels and retain the inclined flanges of the sections. Furthermore, the double-flanged metal sections prevent the ingress of moisture between panels, and a flame barrier in the event of fire.

I claim:

1. In an insulation panel assembly for use in the roofing and/or the cladding walls of buildings, comprising an elongate panel having two major faces and two longitudinal side edge faces, and two elongate metal sections, each comprising a web engaging on one side thereof one of the side edge faces, a first flange at one longitudinal edge of the web and extending at right angles to the web from one side thereof, a second flange at the other longitudinal edge of the web for the extending at an inclination to the web from the one side thereof and towards the first flange, and a channel in the web opening to the other side of the web for receiving a vapour seal, the improvement wherein the panel is preformed from mineral fibres having a density of not less than 180 kg/m$^3$, the first flange of each section is fitted flush against one of the major faces of the panel, the second flange is fitted into a correspondingly inclined first groove extending the full length of the panel and cut into the respective side edge face of the panel intermediate the major faces thereof, and the channel is fitted into a corresponding second groove cut into the respective side edge face of the panel intermediate the inclined first groove and the one major face of the panel exclusively by sliding the section along the respective side edge of the panel, and a metal sheet is placed loosely on the other major face of the panel.

2. An insulation panel according to claim 1, wherein the density of the panel is 200 Kg/M$^3$.

3. An insulation panel according to claim 1, wherein the web of each metal section has a groove therein for receiving a vapour seal between it and an opposing groove in an adjacent panel of roofing or wall cladding, the vapour seal being bonded into the groove of the metal section on one side edge face of the panel, and each side edge face of the panel has a groove cut thereinto and receiving the groove in the web of its metal section.

4. An insulation panel according to claim 1, wherein the said one major face of the panel has a lining sheet bonded thereto.

5. An insulation panel according to claim 1, wherein the other major face of the panel has bonded thereto a plurality of laterally-spaced and parallel bars of trapezoidal cross-section extending the full length of the panel, and said metal sheet is profiled with corrugations therein matching the bars loosely covers the exposed portions of said other major face of the panel and the bars, the bars being of the same material as the panel.

* * * * *